US005842483A

United States Patent [19]

Timko

[11] Patent Number: 5,842,483

[45] Date of Patent: Dec. 1, 1998

[54] SUPPORT TRAYS FOR A HAND AND FOOT

[76] Inventor: Joan F. Timko, 2240 W. Edgerton, Broadview Heights, Ohio 44147

[21] Appl. No.: 1,725

[22] Filed: Dec. 31, 1997

[51] Int. Cl.[6] ..... A45D 29/00

[52] U.S. Cl. ..... 132/73; D28/61

[58] Field of Search ..... 132/73, 200, 73.5; D28/61

[56] References Cited

U.S. PATENT DOCUMENTS

| | | | |
|---|---|---|---|
| D. 155,435 | 10/1949 | Mangold | 132/73 |
| D. 158,223 | 4/1950 | Schubert et al. | 132/73 |
| D. 167,672 | 9/1952 | Blackburn | D28/61 |
| D. 300,066 | 2/1989 | Spradley | D28/61 |
| D. 307,492 | 4/1990 | Whitney | D28/61 |
| D. 327,176 | 6/1992 | Gil | D6/335 |
| 2,477,921 | 8/1949 | Batton et al. | 132/73 |
| 2,580,981 | 1/1952 | Webster | 132/73 |
| 3,865,122 | 2/1975 | Dabbs | 132/73 |
| 3,870,058 | 3/1975 | Merriman | 132/73 |
| 4,441,487 | 4/1984 | Daugherty et al. | 132/73 |
| 4,585,017 | 4/1986 | Trujillo | 132/73 |

*Primary Examiner*—Paul J. Hirsch

[57] ABSTRACT

A new support trays for a hand and foot for providing a support rest for a foot or hand while permitting accessibility to the nails for pedicures or manicures. The inventive device includes a tray member with a skirt wall outwardly extending from the lower surface of the tray member around the outer perimeter of the tray member. The upper surface of the tray member has a depression formed therein for resting an extremity of a human limb. Such as a hand or a foot, therein.

15 Claims, 2 Drawing Sheets

SUPPORT TRAYS FOR A HAND AND FOOT

BACKGROUND OF THE INVENTION

1. Field of the Invention

The present invention relates to manicure and pedicure support devices and more particularly pertains to a new support trays for a hand and foot for providing a support rest for a foot or hand while permitting accessibility to the nails for pedicures or manicures.

2. Description of the Prior Art

The use of manicure and pedicure support devices is known in the prior art. More specifically, manicure and pedicure support devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art manicure and pedicure support devices include U.S. Pat. No. 4,585,017; U.S. Pat. No. 3,961,636; U.S. Pat. No. 4,332,263; U.S. Pat. No. Des. 327,176; U.S. Pat. No. 4,296,766; and U.S. Pat. No. 4,915,331.

While these devices fulfill their respective, particular objectives and requirements, the aforementioned patents do not disclose a new support trays for a hand and foot. The inventive device includes a tray member with a skirt wall outwardly extending from the lower surface of the tray member around the outer perimeter of the tray member. The upper surface of the tray member has a depression formed therein for resting an extremity of a human limb, such as a hand or a foot, therein.

In these respects, the support trays for a hand and foot according to the present invention substantially departs from the conventional concepts and designs of the prior art, and in so doing provides an apparatus primarily developed for the purpose of providing a support rest for a foot or hand while permitting accessibility to the nails for pedicures or manicures.

SUMMARY OF THE INVENTION

In view of the foregoing disadvantages inherent in the known types of manicure and pedicure support devices now present in the prior art, the present invention provides a new support trays for a hand and foot construction wherein the same can be utilized for providing a support rest for a foot or hand while permitting accessibility to the nails for pedicures or manicures.

The general purpose of the present invention, which will be described subsequently in greater detail, is to provide a new support trays for a hand and foot apparatus and method which has many of the advantages of the manicure and pedicure support devices mentioned heretofore and many novel features that result in a new support trays for a hand and foot which is not anticipated, rendered obvious suggested, or even implied by any of the prior art manicure and pedicure support devices, either alone or in any combination thereof.

To attain this, the present invention generally comprises a tray member with a skirt wall outwardly extending from the lower surface of the tray member around the outer perimeter of the tray member. The upper surface of the tray member has a depression formed therein for resting an extremity of a human limb such as a hand or a foot, therein.

There has thus been outlined rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new support trays for a hand and foot apparatus and method which has many of the advantages of the manicure and pedicure support devices mentioned heretofore and many novel features that result in a new support trays for a hand and foot which is not anticipated, rendered obvious, suggested, or even implied by any of the prior art manicure and pedicure support devices, either alone or in any combination thereof.

It is another object of the present invention to provide a new support trays for a hand and foot which may be easily and efficiently manufactured and marketed.

It is a further object of the present invention to provide a new support trays for a hand and foot which is of a durable and reliable construction.

An even further object of the present invention is to provide a new support trays for a hand and foot which is susceptible of a low cost of manufacture with regard to both materials and labor, and which accordingly is then susceptible of low prices of sale to the consuming public, thereby making such support trays for a hand and foot economically available to the buying public.

Still yet another object of the present invention is to provide a new support trays for a hand and foot which provides in the apparatuses and methods of the prior art some of the advantages thereof, while simultaneously overcoming some of the disadvantages normally associated therewith.

Still another object of the present invention is to provide a new support trays for a hand and foot for providing a support rest for a foot or hand while permitting accessibility to the nails for pedicures or manicures.

Yet another object of the present invention is to provide a new support trays for a hand and foot which includes a tray member with a skirt wall outwardly extending from the lower surface of the tray member around the outer perimeter of the tray member. The upper surface of the tray member has a depression formed therein for resting an extremity of a human limb, such as a hand or a foot, therein.

Still yet another object of the present invention is to provide a new support trays for a hand and foot that supports a hand or a foot while drying nail polish on finger nails and toe nails.

Even still another object of the present invention is to provide a new support trays for a hand and foot that are safe and comfortable for resting the palm of a hand or the sole of a foot on.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
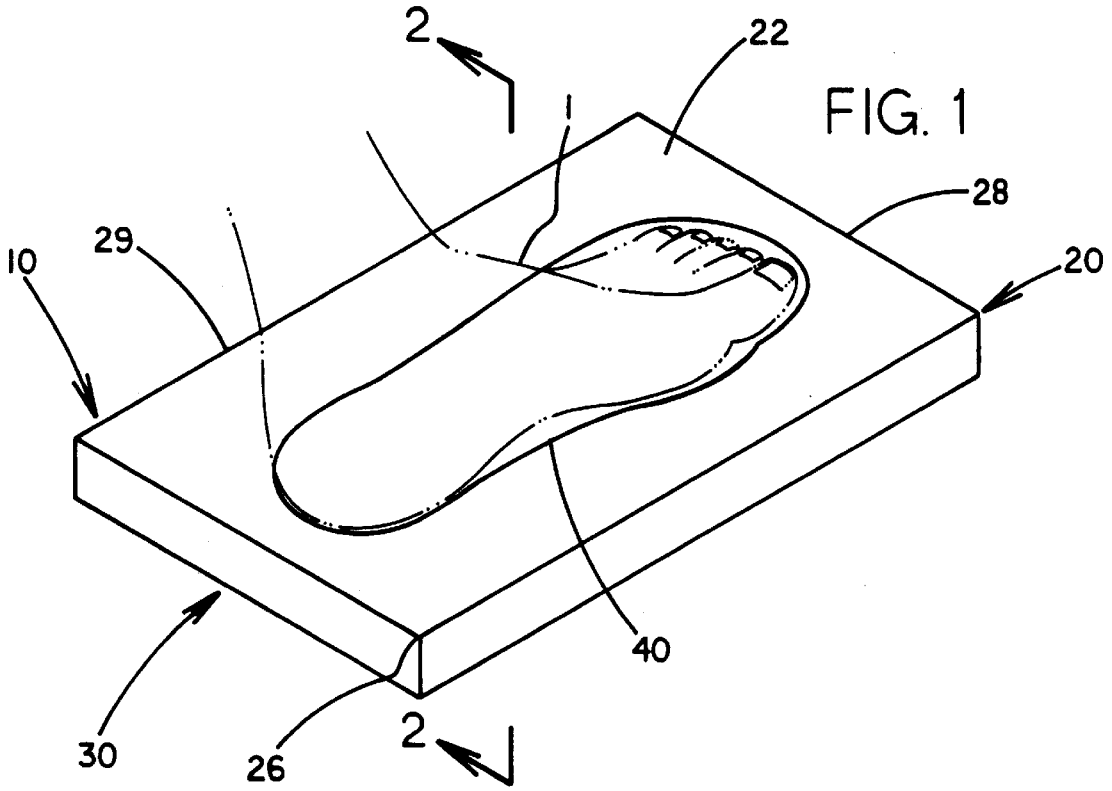
FIG. 1 is a schematic perspective view of a new support trays for a hand and foot in use according to the present invention.

With reference now to the drawings, and in particular to FIGS. 1 through 4 thereof, a new support trays for a hand and foot embodying the principles and concepts of the present invention and generally designated by the reference numeral 10 will be described.

As best illustrated in FIGS. 1 through 4, the support trays for a hand and foot 10 generally comprises a tray member 20 with a skirt wall 30 outwardly extending from the lower surface 24 of the tray member 20 around the outer perimeter 26 of the tray member 20. The upper surface 22 of the tray member 20 has a depression 40 formed therein for resting an extremity of a human limb 1 such as a hand or a foot, therein.

Preferably, the tray member 20 is generally rectangular in shape and has a pair of lateral sides 28 and a pair of longitudinal sides 29 extending between the lateral sides 28 of the tray member 20. The tray member 20 is ideally large enough to permit resting of an entire hand or foot 1 thereon. Illustratively, the lateral sides 28 of the tray member have a length of at least about 10 inches while the longitudinal sides each have a length of at least about 12 inches for a hand sized support tray 14, or at least about 14 inches for a foot sized support tray 12.

Figure 2:
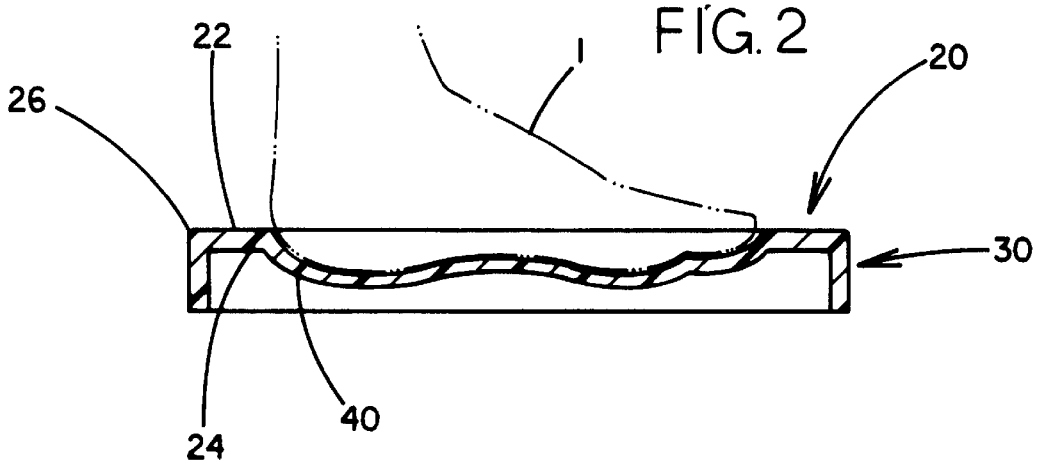
FIG. 2 is a schematic cross sectional view of the present invention taken from line 2—2 on FIG. 1.
Figure 3:
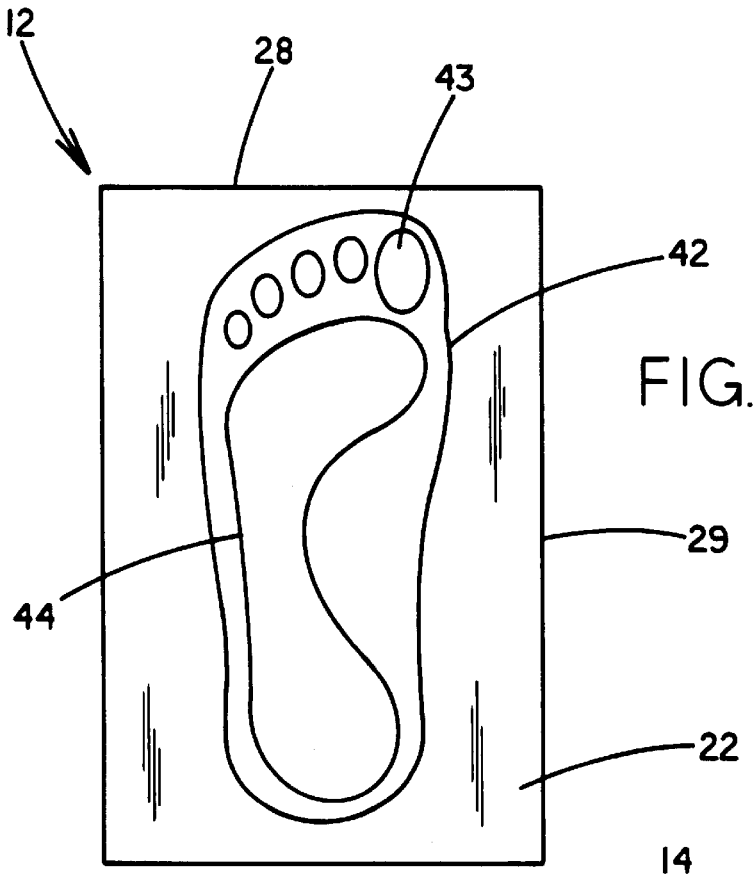
FIG. 3 is a schematic top side view of the foot depression embodiment of the present invention.
Figure 4:
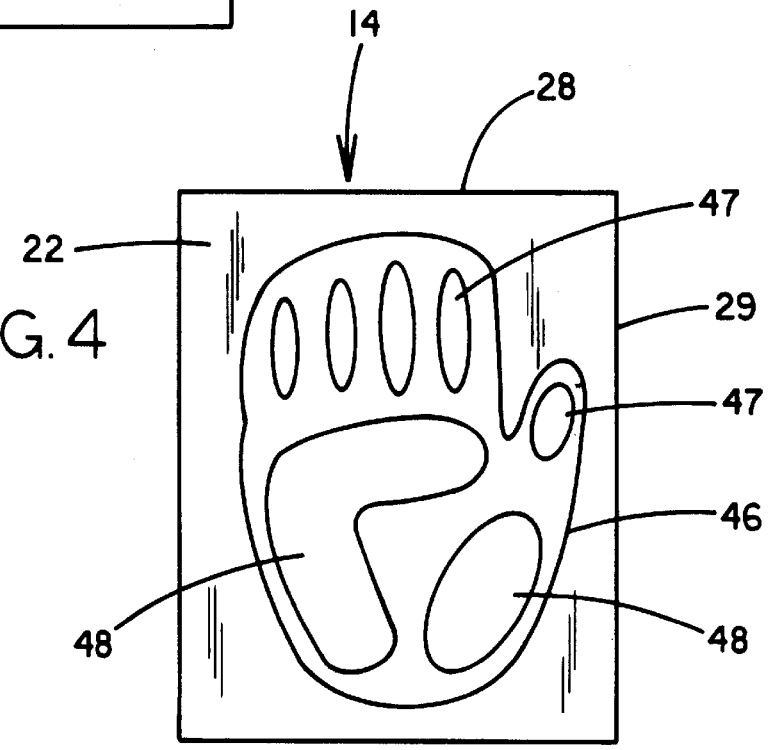
FIG. 4 is a schematic top side view of the hand depression embodiment of the present invention.

The upper surface 22 of the tray member 20 is, preferably, substantially planar and includes a depression 40 formed therein for resting an extremity of a human limb therein 1. Ideally, as illustrated in FIG. 2, the depression 40 is formed or shaped to generally conform and fit with the contours of the extremity of the human limb 1. With reference to FIG. 4, in the hand sized support tray 14 the depression 46 is ideally formed to generally conform with the palm of a human hand with a plurality of digit recesses 47 arranged to conform with the thumb and fingers of a hand and palm recesses 48 arranged to conform with the palm of a hand. With reference to FIG. 3, in the foot sized support tray 12 the depression 42 is ideally formed to generally conform with the sole of a human foot with a plurality of digit recesses 43 arranged to conform with the toes of a foot and a sole recess 44 arranged to conform with the sole of a foot.

In use the support tray 10 is designed for resting the extremity of a human limb 1, such as a hand or a foot so that the nails of the extremity 1 may be accessible for performing manicures or pedicures and for allowing the nails to be ideally positioned for adequate drying space when finger-nail or toe-nail painting the support tray comprising:

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

I claim:

1. A support tray for resting the extremity of a human limb such as a hand or a foot, said support tray comprising:

a tray member having an upper surface, a lower surface, and an outer periphery;

a skirt wall being outwardly extended from said lower surface around said outer perimeter of said tray member;

said upper surface of said tray member having a contoured depression formed therein for resting an extremity of a human limb therein, said contoured depression having a non-planar upper surface and an outer perimeter substantially corresponding to the shape of the outer perimeter of the surface of the human limb to be supported on said tray member;

wherein a portion of said upper surface of said tray member surrounding said depression defines an upper plane; and wherein the entire area of said upper surface bounded by said outer perimeter of said depression is depressed below the upper plane such that the surface of the extremity of the human limb placed in contact with the upper surface is located below said upper plane for resisting inadvertent movement of the extremity.

2. The support tray of claim 1, wherein said tray member is generally rectangular.

3. The support tray of claim 1, wherein said tray member comprises plastic and wherein said skirt wall comprises plastic.

4. The support tray of claim 3, wherein said skirt wall is formed substantially continuous with said tray member.

5. The support tray of claim 1, wherein said skirt wall extends substantially perpendicular to the plane of said upper surface of said tray member.

6. The support tray of claim 1, wherein said depression is formed to generally conform with the contours of the extremity of a human limb.

7. The support tray of claim 6, wherein said depression is formed to generally conform with the palm of a human hand.

8. The support tray of claim 6, wherein said depression is formed to generally conform with the sole of a human foot.

9. A support tray for resting the extremity of a human limb such as a hand or a foot, said support tray comprising:

a tray member having an upper surface, a lower surface, and an outer periphery, said tray member being generally rectangular, wherein said tray member comprises plastic;

a skirt wall being outwardly extended from said lower surface around said outer perimeter of said tray member, wherein said skirt wall extends substantially perpendicular to the plane of said upper surface of said tray member, wherein said skirt wall is formed substantially continuous with said tray member, wherein said skirt wall comprises plastic;

said upper surface of said tray member having a contoured depression formed therein for resting an extremity of a human limb therein, said contoured depression to generally conform with the contours of the extremity of the having an outer perimeter substantially corresponding to the size of the outer perimeter of the surface of the human limb to be supported on said tray member;

wherein a portion of said upper surface of said tray member surrounding said depression defines an upper plane;

wherein the entire area of said upper surface bounded by said outer perimeter of said depression is depressed below the upper plane such that the surface of the extremity of the human limb placed in contact with the upper surface is located below said upper plane for resisting inadvertent movement of the extremity;

said depression having a plurality of digit recesses arranged to conform with the contours of the extremity of the human limb; and said tray member having a pair of lateral sides and a pair of longitudinal sides, said lateral sides each having a length of at least about 10 inches, said longitudinal sides each having a length of at least about 12 inches.

10. The support tray of claim 7, wherein said tray member is generally rectangular and has a pair of lateral sides and a pair of longitudinal sides, said lateral sides each having a length of at least about 10 inches, said longitudinal sides each having a length of at least about 12 inches.

11. The support tray of claim 8, wherein said tray member is generally rectangular and has a pair of lateral sides and a pair of longitudinal sides, said lateral sides each having a length of at least about 10 inches, said longitudinal sides each having a length of at least about 14 inches.

12. The support tray of claim 7, wherein said depression has a plurality of digit recesses arranged to conform with a thumb and forefingers of the human hand.

13. The support tray of claim 8, wherein said depression has a plurality of digit recesses arranged to conform with toes of the human foot.

14. The support tray of claim 7, wherein said depression has a plurality of digit recesses arranged to conform with the palm of the human hand.

15. The support tray of claim 8, wherein said depression has a plurality of digit recesses arranged to conform with the sole of the human foot.

* * * * *